US008567528B2

(12) United States Patent
Comeau et al.

(10) Patent No.: US 8,567,528 B2
(45) Date of Patent: Oct. 29, 2013

(54) APPARATUS AND METHOD FOR DIRECTIONAL DRILLING

(75) Inventors: Laurier E. Comeau, Leduc (CA); Christopher Konschuh, Calgary (CA)

(73) Assignee: Arrival Oil Tools, Inc., Calgary, Alberta (CA)

( * ) Notice: Subject to any disclaimer, the term of this patent is extended or adjusted under 35 U.S.C. 154(b) by 568 days.

(21) Appl. No.: 12/850,670

(22) Filed: Aug. 5, 2010

(65) Prior Publication Data

US 2012/0031676 A1 Feb. 9, 2012

(51) Int. Cl.
*E21B 4/16* (2006.01)

(52) U.S. Cl.
USPC ..... 175/95; 175/61; 175/73

(58) Field of Classification Search
USPC ..... 166/95, 61, 73; 175/95, 61, 73
See application file for complete search history.

(56) References Cited

U.S. PATENT DOCUMENTS

| | | | | |
|---|---|---|---|---|
| 5,390,153 | A | 2/1995 | Scherbatskoy | |
| 5,437,338 | A | 8/1995 | Martin | |
| 5,535,835 | A | 7/1996 | Walker | |
| 6,571,888 | B2 | 6/2003 | Comeau | |
| 6,585,061 | B2 | 7/2003 | Radzinski | |
| 8,151,907 | B2 * | 4/2012 | MacDonald | 175/95 |
| 2004/0222023 | A1 | 11/2004 | Haci et al. | |
| 2005/0274548 | A1 | 12/2005 | Albert et al. | |
| 2009/0183921 | A1 | 7/2009 | Gurjar et al. | |
| 2009/0272578 | A1 | 11/2009 | MacDonald | |

OTHER PUBLICATIONS

Great Britain Combined Search and Examination Report for GB Application No. 1108235.1, dated Jul. 4, 2011, 2 pages.
Canadian Office Action for Canadian Patent Application No. 2,739,978 dated Mar. 15, 2013, 3 pages.

* cited by examiner

*Primary Examiner* — Giovanna Wright
*Assistant Examiner* — Wei Wang
(74) *Attorney, Agent, or Firm* — Wong, Cabello, Lutsch, Rutherford & Brucculeri, LLP.

(57) ABSTRACT

A directional drilling system and method are provided for directional drilling a borehole by continuous rotating of the drill string in combination with an arrangement of drilling motor assemblies at the lower end of the drill string to effect drilling along a curved path and a substantially straight path. A first drilling motor assembly is coupled to a drill bit and operable to rotate the drill bit to effect drilling of the borehole. A second drilling motor assembly, positioned on the drill string above the first drilling motor assembly, is operable to rotate the first drilling motor assembly in a direction opposite the direction of rotation imparted to the drill string from the surface and to the drill bit by the first drilling motor assembly. A control system associated with the second drilling motor assembly controls fluid flow through the second drilling motor assembly so that the first drilling motor assembly is substantially rotationally stationary with respect to the rotating drill string when drilling a curved path of the borehole.

16 Claims, 3 Drawing Sheets

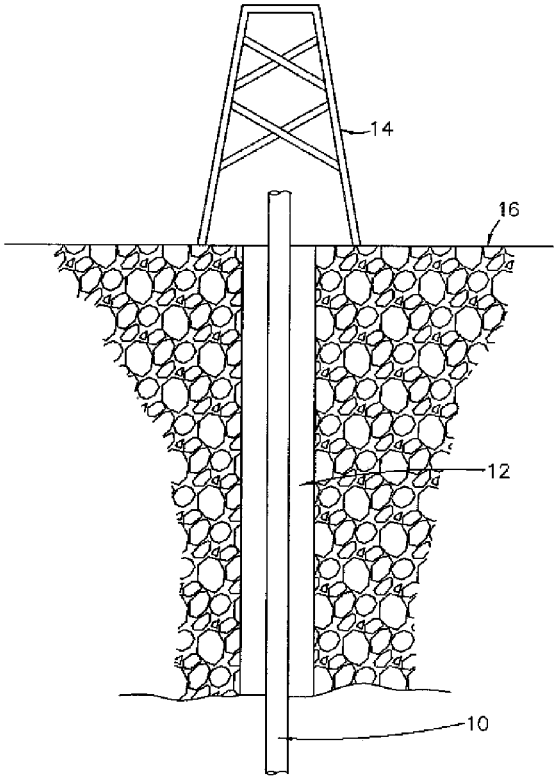
FIG. 1
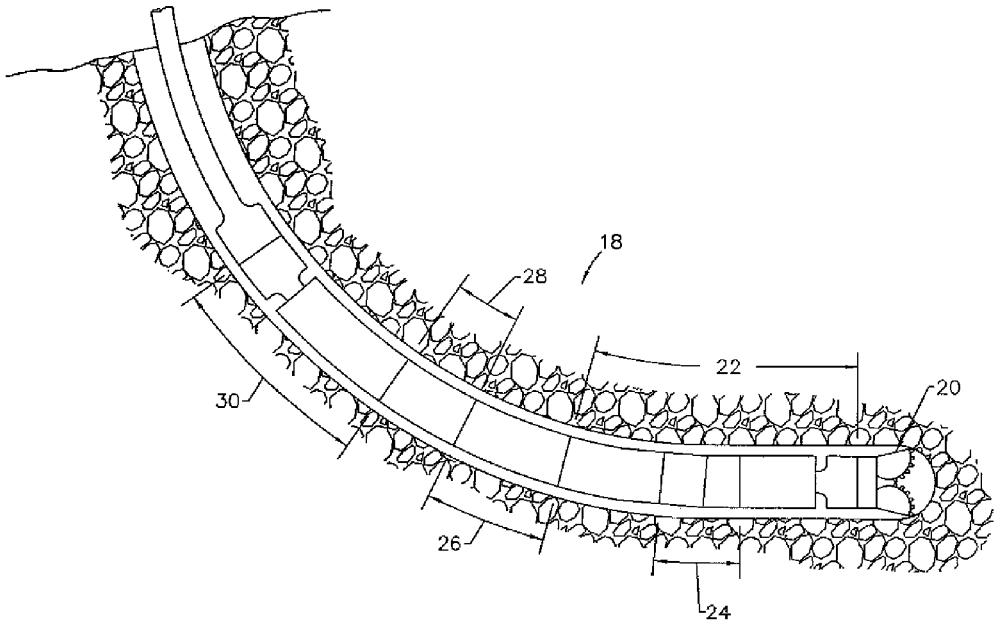

APPARATUS AND METHOD FOR DIRECTIONAL DRILLING

FIELD OF THE INVENTION

The present invention relates to directional drilling and more specifically to an arrangement of drilling motor assemblies suitable for use in downhole drilling operations.

BACKGROUND

Directional drilling can be described as the intentional deviation of a wellbore from the path it would naturally take. This is accomplished through the use of whipstocks, bottom-hole assembly (BHA) configurations, instruments to measure the path of the wellbore in three-dimensional space, data links to communicate measurements taken downhole to the surface, mud motors and special BHA components and drill bits. In some cases, such as drilling steeply dipping formations or unpredictable deviation in conventional drilling operations, directional-drilling techniques may be employed to ensure that the hole is drilled vertically.

The most common way to directional drill is through the use of a bend near the bit in a downhole steerable mud motor. Directional drilling is accomplished with the alternating combination of two drilling operations. In the sliding mode the drill string is slowly rotated to orient the bend in the desired direction so that the bend points the bit in a direction different from the axis of the wellbore. Once oriented by pumping mud through the mud motor, the bit turns while the drill string does not rotate but rather slides, allowing the bit to drill in the direction it points. When a particular wellbore direction is achieved, that direction may be maintained by rotating the entire drill string so that the bit does not drill in a single direction off the wellbore axis, but instead sweeps around and its net direction coincides with the existing wellbore.

In directional drilling operations the sliding phase of drilling lacks the efficiency associated with rotating the drill string. This inefficiency is a result of the drag of the sliding drill string along the borehole and the sole use of the mud motor for drilling the borehole.

In recent years the industry has seen the development of rotary steerable systems for used in directional drilling. These systems employ the use of specialized downhole equipment to replace conventional directional tools such as mud motors. A rotary steerable tool is designed to drill directionally with continuous rotation of the drill string from the surface, eliminating the need to slide a steerable mud motor. Continuous rotation of the drill string allows for improved transportation of drilled cuttings to the surface resulting in better hydraulic performance and reduced well bore tortuosity due to utilizing a steadier steering model. Rotary steerable systems are costly as compared to mud motor systems, so more the traditional mud motor systems are more economically preferable in conventional directional drilling applications.

The subject matter of the present disclosure is directed to overcoming, or at least reducing the effects of, one or more of the problems set forth above.

SUMMARY

A directional drilling system and method are provided for directional drilling a borehole by continuous rotating of the drill string in combination with an arrangement of drilling motor assemblies at the lower end of the drill string to effect drilling along a curved path and a substantially straight path. A first drilling motor assembly is coupled to a drill bit and operable to rotate the drill bit to effect drilling of the borehole. The first drilling motor assembly is configured to angularly tilt the rotational axis of the drill bit relative to the axis of the section of the borehole being drilled to provide directionality to the borehole. A second drilling motor assembly, positioned on the drill string above the first drilling motor assembly is operable to rotate the first drilling motor assembly in a direction opposite the direction of rotation imparted to the drill string from the surface and to the drill bit by the first drilling motor assembly. The rotational speed of the second drilling motor assembly is controlled by a control assembly. A control assembly associated with the second drilling motor assembly controls fluid flow through the second drilling motor assembly so that the first drilling motor assembly is substantially rotationally stationary with respect to the rotating drill string when drilling a curved path of the borehole.

The foregoing summary is not intended to summarize each potential embodiment or every aspect of the present disclosure.

BRIEF DESCRIPTION OF THE DRAWINGS

FIG. 1 is a diagrammatic view of the apparatus in use for directional drilling;

DETAILED DESCRIPTION

Figure 2:
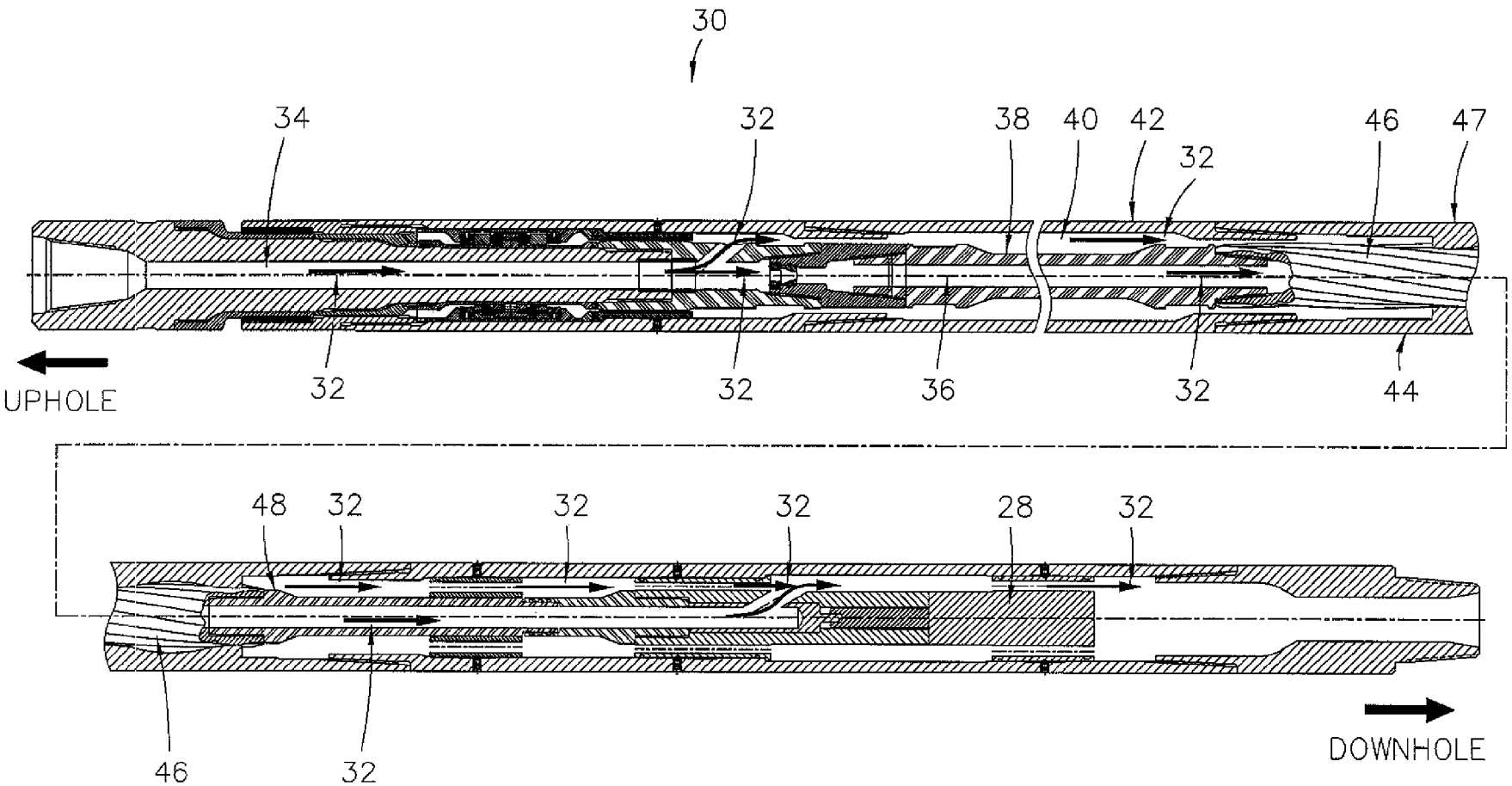
FIG. 2 is a diagrammatic view of the second drilling motor assembly illustrating the fluid flow path through the second drilling motor assembly

In describing various locations relative to the Figures the term "downhole" refers to the direction along the axis of the wellbore that looks toward the furthest extent of the wellbore. Downhole is also the direction toward the drill bit location. Similarly, the term "lower end" refers to the portion of the assembly located at the downhole end of the respective assembly. The term "uphole" refers to the direction along the axis of the wellbore that leads back to the surface, or away from the drill bit. Similarly, the term "upper end" refers to the portion of the assembly located at the uphole end of the respective assembly. The term "clockwise" refers to rotation to the right as seen looking downhole and the term "counter-clockwise" refers to rotation to the left as seen looking downhole. In a situation where the drilling is more or less along a vertical path, downhole is truly in the down direction, and uphole is truly in the up direction. However, in horizontal drilling, the terms up and down are ambiguous, so the terms downhole and uphole are necessary to designate relative positions along the drill string.

Referring to FIG. 1, the drill string 10 within a borehole 12 is rotatable by a drilling rig 14 located at the earth's surface 16. Rotation of the drill string 10 is provided from the surface in a manner known in the art, such as by a rotary table or a top drive system. A bottom hole assembly 18, commonly referred to as a BHA, is coupled to the downhole end of the drill string 10. The BHA 18 comprises a drill bit 20 at the downhole end of the BHA 18 which is coupled to a first drilling motor assembly 22, which may comprise a downhole steerable mud motor. The first drilling motor assembly 22 includes a bent housing member 24. An MWD assembly 26 is coupled to the uphole end of the first drilling motor assembly 22. A control assembly 28 is coupled to the uphole end of the MWD assembly 26 and a second drilling motor assembly 30 is coupled to the uphole end of the control assembly 28. The uphole end of the second drilling motor assembly drilling 30 is connected to drill string 10.

In the illustrated embodiment the first drilling motor assembly 22, as known in the drilling art, comprises a connecting sub, which connects the first drilling motor assembly 22 to the drill string 10, a power section, which consists of the rotor and stator; a transmission section, where the eccentric power from the rotor is transmitted as concentric power to rotate the drill bit 20 in a first direction; a bearing assembly which protects from off bottom and on bottom pressures; and a bottom sub which connects the first drilling motor assembly 22 to the drill bit 20. In the preferred embodiment the drill bit 20 is rotated by the first drilling motor assembly 22 in a first rotational direction for drilling the borehole 12. In the preferred embodiment, the first rotational direction is clockwise.

The bent housing 24 is included in the first drilling motor assembly 22. The bent housing assembly 24 can be configured to have a bend using different bend angle settings. The bent housing assembly 24 may comprise a fixed bent housing assembly, which has a fixed bend angle, or an adjustable bent housing assembly, which has the ability to pre-set the bend angle before the BHA is placed in the borehole or which has the ability to adjust the bend angle during the drilling operations. Typically, the bent housing assembly 24 can have an angle setting from 0 degrees to 4 degrees. The amount of bend angle is determined by rate of directional change needed to reach the drilling target zone.

The MWD assembly 26, coupled to the uphole end of the first drilling motor assembly 22, may contain a steering system, incorporating magnetometers and accelerometers to measure and transmit data related to inclination, direction and orientation of the BHA 18 within the borehole 12 to equipment at the surface. An operator can periodically or continuously monitor the tool face orientation of the BHA 18 through periodic data surveys of inclination, direction and orientation to control the drilling process. An example of the process of monitoring tool face is shown in U.S. Pat. No. 6,585,061, which is incorporated herein by reference.

The control assembly 28 is coupled to the uphole end of the MWD assembly 26 and the downhole end of the second drilling motor assembly 30 is coupled to the uphole end of the control assembly 28. The second drilling motor assembly 30, coupled at the uphole end to the drill string 10, includes a power section, which consists of the rotor and stator; a transmission section, where the eccentric power from the rotor is transmitted as concentric power which can rotate the first drilling assembly 22 in a second direction; a bearing assembly which protects from pressures; and a bottom sub which connects the second drilling motor assembly 30 to the first drilling motor assembly 22. In the preferred embodiment, the second drilling motor assembly 30 comprises a low speed, high torque power section, having a rotational speed in the range from approximately 25 rpm to approximately 80 rpm and a torque range from approximately 2,500 ft. lbs. to 28,000 ft. lbs. depending on the motor diameter which can be of a diameter from 2⅞ inches to 11¼ inches, and configured for rotating the first drilling motor assembly 22 in the second direction. In the preferred embodiment, the second direction is the counterclockwise.

As the general operation of the second drilling motor assembly 30 is known in the art of drilling, such operation will not be detailed in reference to FIG. 2. Rather, in FIG. 2 there is illustrated in more detail the second drilling motor assembly 30 showing the fluid flow path noted by arrows 32 through the second drilling motor assembly 30. Fluid is pumped from the surface through the drill pipe 10 into the uphole end of the second drilling motor assembly 30 which is connected to the drill pipe 10. The fluid flows into the central annulus 34 in the downhole direction where a portion of the fluid flows through the passage 36 through the upper flex shaft 38 and a portion of the fluid is diverted to flow in the annulus 40 between the housing 42 and the upper flex shaft 38. The fluid flowing in the annulus 40 continues to flow through the second drilling motor assembly 30 passing through the rotor/stator section 44 to provide rotational motion of the stator 47 in the counterclockwise direction. The portion of the fluid flow through the passage 36 through the upper flex shaft 38 continues to flow in the downhole direction through the lower flex shaft 48 which is connected to the downhole end of the rotor 46. Coupled to the downhole end of the lower flex shaft 48 is the control assembly 28, which will be described in more detail in reference to FIG. 3.

The control assembly 28, may be coupled to the uphole end of the MWD assembly 26 and the downhole end of the second drilling motor assembly 30 or the control assembly 28 may be incorporated into the second drilling motor assembly 30, as illustrated in FIG. 2.

Figure 3:
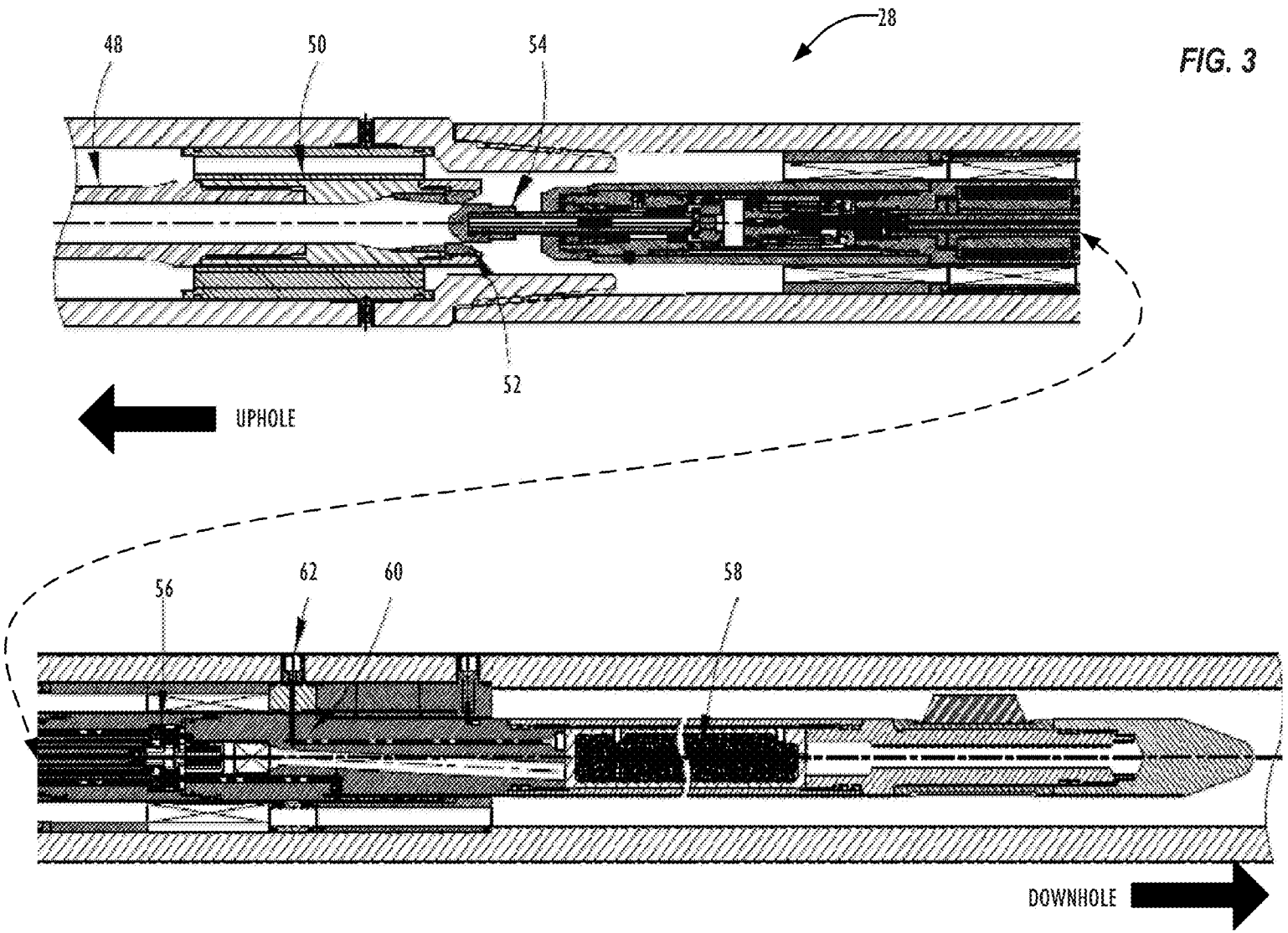
FIG. 3 is a schematic view of the fluid control system for controlling fluid flow through the second drilling motor assembly.

Referring to FIG. 3, control assembly 28 is illustrated in more detail. In the illustrated configuration the uphole end of control assembly 28 is connected to the downhole end of the second drilling motor assembly 30. The downhole end portion of the lower flex shaft 48 is supported within the housing of the second drilling motor assembly 30 by radial bearing 50. The downhole end portion of flow tube 48 cooperates with poppet 54 to form a control valve to control the fluid flow through rotor 46 of the second drilling motor assembly 30. Control of the fluid flow through rotor 46 of the second drilling motor assembly 30 allows for control of the rotational rate of the second drilling motor assembly 30, which further allows for control of the direction and rate of rotation of the first drilling motor assembly 22.

In the illustrated embodiment, control assembly 28 further includes a turbine assembly 56 driven by fluid flow for generating electrical power for the electronics 58 located in the control assembly 28. The electronics 58 controls the operation of poppet 54 as well as other devices, such as pressure sensor 60, located in control assembly 28. Pressure sensor 60 detects, by way of port 62, pressure command signals transmitted from pressure signaling equipment (not illustrated) locate at the surface 16. It should be recognized that various pressure transmission methods are commonly used in the drilling industry, for example one such system is illustrated in U.S. Pat. No. 5,390,153 which is incorporated herein by reference. In addition, various other methods of transmission are known in the industry, such as wired drill pipe and electromagnetic methods.

The drilling system described herein allows for the continuous rotating of the drill string while orienting in a specific drilling direction and rotating while drilling a substantially straight borehole. In a typical drilling operation, drill string 10 rotation at the surface varies from approximately 30 to 120 rpm. In the event that orientation is required to control deviation or direction of the borehole 12, the drill string 10 rotation from the surface would be slowed preferably to between approximately 35 to 65 rpm. The control assembly 28 will be activated in response to a pressure signal sent from the surface to control fluid bypass through the second motor assembly 30 to regulate the rotational speed of the first drilling motor assembly 22 to a substantially non-rotating position relative to the drill string 10. As torque from the first drilling motor assembly 22 driving the bit 20 changes, the control assembly 28 will control the fluid bypass through the second motor assembly 30 to maintain the rotation speed of the first drilling motor assembly 22 to a substantially non-rotating position relative to the drill string 10. After the desired direction or inclination of the borehole has been achieved, rotation of the drill string 10 from the surface will be increased to the normal range and the control assembly 28 would be set for a fluid bypass level, approximately 50% in the preferred embodiment, typical for normal drilling operations. The tool face data for monitoring the relative rotational position of the first drilling motor assembly 22 is be derived from the MWD assembly 26.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. Apparatus for drilling a borehole while rotating a drill string in a first rotational direction, comprising:

a drill bit;

a first drilling motor assembly for rotating said drill bit in said first rotational direction at a first rotational speed;

a second drilling motor assembly connected between said first drilling motor assembly and said drill string for rotating said first drilling motor assembly in a second rotational direction at a second rotational speed; and a control assembly for controlling the second rotational speed relative to said rotating drill string, comprising:

a poppet, adapted to control flow of fluid through the second drilling motor assembly for controlling the second rotational speed; and electronic control circuitry operable to control the operation of the poppet.

2. The apparatus of claim 1 wherein said first rotational direction is clockwise.

3. The apparatus of claim 2 wherein said second rotational direction is counterclockwise.

4. The apparatus of claim 1 wherein controlling the second rotational speed relative to said rotating drill string further comprises said control assembly controlling the second rotational speed so that said first drilling motor assembly is substantially rotationally stationary relative to a rotational speed of said drill string.

5. The apparatus of claim 4 wherein said second drilling motor assembly comprises a low speed drilling motor.

6. The apparatus of claim 5 wherein said low speed drilling motor has a rotational speed in the range from approximately 25 rpm to approximately 80 rpm.

7. The apparatus of claim 5 wherein said second drilling motor further comprises a high torque drilling motor.

8. The apparatus of claim 7 wherein said second drilling motor has a torque in the range of approximately 2,500 foot pounds to approximately 28,000 foot pounds.

9. The apparatus of claim 1, wherein the control assembly further comprises:

a pressure sensor, coupled to the electronic circuitry, operable to detect pressure wave signals and convert the pressure wave signals into electrical control signals for the electronic circuitry.

10. The apparatus of claim 1, wherein the control assembly further comprises:

a fluid-driven turbine assembly, operable to provide electrical power to the electronic control circuitry.

11. A method for drilling a borehole, comprising:

rotating a drill string in a first rotational direction at a first rotational speed;

rotating a drill bit in said first rotational direction using a first drilling motor assembly;

rotating the first drilling motor assembly in a second rotational direction at a second rotational speed using a second drilling motor assembly; and controlling the second rotational speed relative to the first rotational speed, comprising:

controlling fluid flow through the second drilling motor with a poppet to control the second rotational speed; and controlling positioning of the poppet with an electronic control system.

12. The method of claim 11 wherein said first rotational direction is clockwise.

13. The method of claim 12 wherein said second rotational direction is counterclockwise.

14. The method of claim 12 wherein controlling the second rotational speed relative to the first rotational speed further comprises controlling the second rotational speed so that said first drilling motor assembly is substantially rotationally stationary relative to the first rotational speed.

15. The method of claim 11, signalling the electronic control system using fluid-borne pressure wave signals.

16. The method of claim 11, further comprising: powering the electronic control system with a fluid flow driven turbine.

* * * * *